US006583555B2

(12) United States Patent
Matsukawa et al.

(10) Patent No.: US 6,583,555 B2
(45) Date of Patent: Jun. 24, 2003

(54) FLAT FLUORESCENT LAMP AND OPTICAL FIXING DEVICE

(75) Inventors: Hiroyuki Matsukawa, Saitama (JP); Nobuo Katsuma, Saitama (JP); Yoshihiro Yamaguchi, Saitama (JP); Hiroshi Fukuda, Saitama (JP); Satoru Ikeya, Saitama (JP); Akihiko Machida, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 140 days.

(21) Appl. No.: 09/933,831

(22) Filed: Aug. 22, 2001

(65) Prior Publication Data

US 2002/0024294 A1 Feb. 28, 2002

(30) Foreign Application Priority Data

Aug. 25, 2000 (JP) ..... 2000-255239

(51) Int. Cl.[7] ..... H01J 63/04

(52) U.S. Cl. ..... 313/495; 313/582; 313/586; 313/311; 313/484

(58) Field of Search ..... 313/484, 485, 313/495, 496, 497, 514, 517, 518, 633, 635, 582, 586, 587, 306, 309, 310, 311, 336, 357

(56) References Cited

U.S. PATENT DOCUMENTS 5,558,554 A * 9/1996 Finklea et al. ..... 313/495
6,411,032 B1 * 6/2002 Shiiki et al. ..... 313/582

FOREIGN PATENT DOCUMENTS

JP A 6-089653 3/1994 ..... H01J/1/30

* cited by examiner

*Primary Examiner*—Ashok Patel
*Assistant Examiner*—Sharlene Leurig
(74) *Attorney, Agent, or Firm*—Sughrue Mion, PLLC

(57) ABSTRACT

A flat fluorescent lamp has a vessel or housing including first and second substrates opposed to each other at a small distance, and having discharge gas enclosed therein. A first planar electrode layer being transparent is disposed on an inner surface of the first substrate. A second planar electrode layer is disposed on an inner surface of the second substrate, for electrical discharge in cooperation with the first planar electrode layer. First and second dielectric layers are disposed on respectively the inner surfaces of the first and second substrates to cover the first and second planar electrode layers. First and second fluorescent layers are overlaid on respectively inner surfaces of the first and second dielectric layers, for emitting electromagnetic rays upon the electrical discharge between the first and second planar electrode layers. A pattern of plural projections is formed with the inner surface of the second dielectric layer.

16 Claims, 5 Drawing Sheets

FLAT FLUORESCENT LAMP AND OPTICAL FIXING DEVICE

BACKGROUND OF THE INVENTION

1. Field of the Invention

The present invention relates to a flat fluorescent lamp and optical fixing device. More particularly, the present invention relates to a flat fluorescent lamp and optical fixing device which can emit light at a sufficient amount even upon applying low voltage.

2. Description Related to the Prior Art

In FIG. 5, a conventional flat fluorescent lamp is depicted, and includes a pair of glass substrates 2 and 3, which a spacer 4 keeps at a small distance in parallelism. The glass substrate 2 is coated with a transparent planar electrode layer 2*a*, a transparent dielectric layer 2*b* and a fluorescent layer 2*c* overlaid on one another. The glass substrate 3 is coated with an opaque planar electrode layer 3*a*, a transparent dielectric layer 3*b* and a fluorescent layer 3*c* overlaid on one another. A discharge space 5 is filled with rare gas or mixture of rare gas and mercury vapor sealed therein by the glass substrates 2 and 3 and the spacer 4.

In the flat fluorescent lamp, the transparent dielectric layers 2*b* and 3*b* of glass or the like lie between the transparent and opaque planar electrode layers 2*a* and 3*a*. When a lamp drive device 6 causes the flat fluorescent lamp to illuminate, considerably high voltage must be applied by the lamp drive device 6 in comparison with voltage to be applied to a conventional light source. To lower the required voltage, it is possible to set high the degree of vacuum by lowering pressure of the sealed gas. However, the higher degree of vacuum raises the manufacturing cost.

JP-A 6-089653 discloses a flat fluorescent lamp in which plural projections are formed on a surface of electrodes. Corners of the projections cause electric field strength to be high, so as to enable driving at a low voltage. However, this type in which local highness in the electric field strength occurs by means of the projections has a shortcoming in that no projections can be formed on a transparent planar electrode layer on an output side of light.

SUMMARY OF THE INVENTION

In view of the foregoing problems, an object of the present invention is to provide a flat fluorescent lamp and optical fixing device which has a simple structure and can emit light at a sufficient amount even upon applying low voltage.

In order to achieve the above and other objects and advantages of this invention, a flat fluorescent lamp has a vessel or housing including first and second substrates opposed to each other at a small distance, and having discharge gas enclosed therein. A first planar electrode being transparent is disposed on an inner surface of the first substrate. A second planar electrode is disposed on an inner surface of the second substrate, for electrical discharge in cooperation with the first planar electrode. First and second dielectric layers are disposed on respectively the inner surfaces of the first and second substrates to cover the first and second planar electrodes. First and second fluorescent layers are overlaid on respectively inner surfaces of the first and second dielectric layers, for emitting electromagnetic rays in response to the electrical discharge between the first and second planar electrodes. At least one protruding pattern is formed with the inner surface of the first and/or second dielectric layers.

The protruding pattern includes plural projections.

The electromagnetic rays are ultraviolet rays or near ultraviolet rays adapted for fixing thermosensitive recording material.

The plural projections are arranged in a matrix manner.

The protruding pattern is formed with the inner surface of the second dielectric layer, and the first substrate emits the electromagnetic rays externally.

In a preferred embodiment, the at least one protruding pattern is first and second protruding patterns formed with respectively the inner surfaces of the first and second dielectric layers.

The first protruding pattern includes a first group of plural projections, the second protruding pattern includes a second group of plural projections, and the plural projections in the second group are offset from the plural projections in the first group.

In another preferred embodiment, the plural projections are arranged in at least first and second projection trains, each of the at least first and second projection trains includes plural projections arranged in a predetermined direction, and projections in the second projection train are disposed alternately with projections in the first projection train with reference to the predetermined direction.

The plural projections have a substantially hemispherical shape.

The plural projections have a height of 1–4 mm and a diameter of 0.5–2.0 mm, and are arranged at a pitch of 2–8 mm.

The first planar electrode is formed from indium tin oxide, the second planar electrode is formed from aluminum, and the first and second dielectric layers are formed from silicon dioxide.

The protruding pattern is formed by photolithography and etching.

In another aspect of the invention, an optical fixing device applies electromagnetic rays to thermosensitive recording material for fixation. The optical fixing device includes a vessel or housing, including first and second substrates opposed to each other at a small distance, and having discharge gas enclosed therein. A first planar electrode being transparent is disposed on an inner surface of the first substrate. A second planar electrode is disposed on an inner surface of the second substrate, for electrical discharge in cooperation with the first planar electrode. First and second dielectric layers are disposed on respectively the inner surfaces of the first and second substrates to cover the first and second planar electrodes. First and second fluorescent layers are overlaid on respectively inner surfaces of the first and second dielectric layers, for emitting the electromagnetic rays in response to the electrical discharge between the first and second planar electrodes. At least one protruding pattern is formed with the inner surface of the first and/or second dielectric layers.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
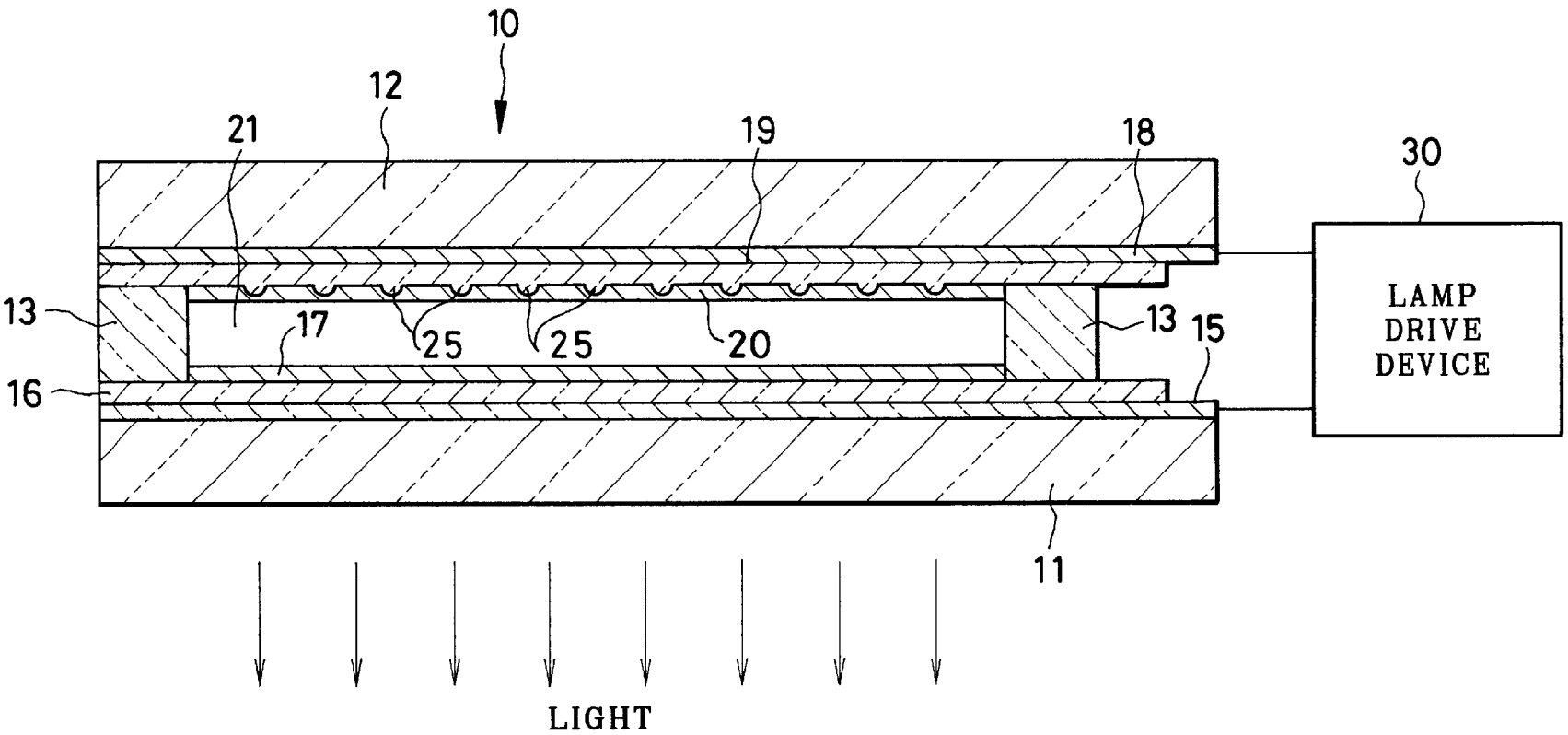
FIG. 1 is a section illustrating a flat flourescent lamp of the invention and a lamp drive device.

In FIG. 1, a flat fluorescent lamp 10 of the invention is depicted in section. The flat fluorescent lamp 10 has a vessel or housing, which includes a pair of glass substrates 11 and 12. The glass substrates 11 and 12 are kept opposed to each other by a spacer 13 at a predetermined interval. An inner surface of the glass substrate 11 is overlaid with a transparent planar electrode layer 15, a transparent dielectric layer 16, and a fluorescent layer 17. An inner surface of the glass substrate 12 is overlaid with an opaque planar electrode layer 18, a transparent dielectric layer 19 and a fluorescent layer 20. There is a discharge space 21 sealed by the glass substrates 11 and 12 and the spacer 13, and filled with discharge gas which is constituted by rear gas and mercury gas. Note that the transparent dielectric layers 16 and 19 are formed from silicon dioxide $SiO_2$. The transparent planar electrode layer 15 is formed from indium tin oxide (ITO). The opaque planar electrode layer 18 is formed from aluminum. Of course, other suitable materials may be used instead.

Figure 2:
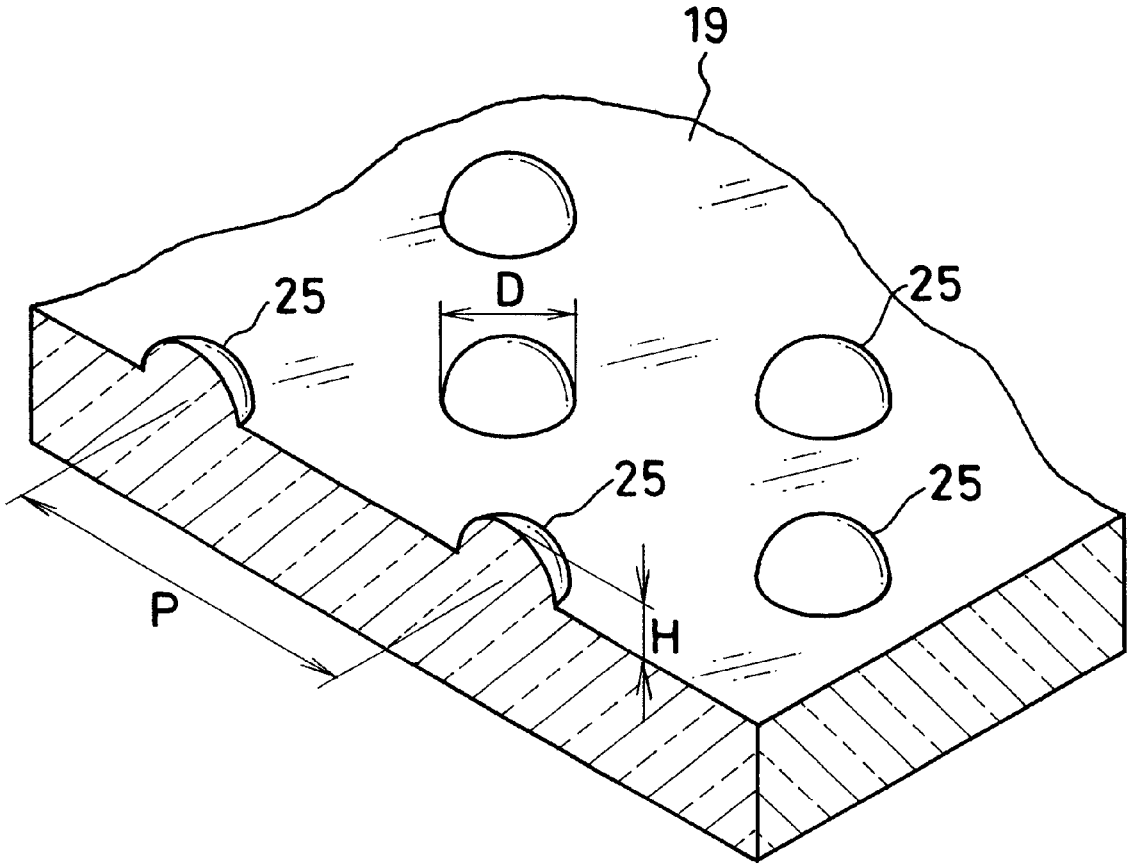
FIG. 2 is a perspective, partially broken, illustrating a transparent dielectric layer with projections.

In FIG. 2, a great number of plural projections 25 in a protruding pattern are formed on a surface of the transparent dielectric layer 19 of the glass substrate 12 opposite to a surface where light is emitted, and arranged in a manner of matrix. The projections 25 protrude in a shape of a hemisphere, and are formed by photolithography and etching. It is alternatively possible to form the projections 25 by finishing according to a mechanical technique. The projections 25 have a height H of 3 mm, and have the periphery of which a diameter D of 1.5 mm. The projections 25 are arranged at a pitch P of 6 mm.

A lamp drive device 30 is connected to the flat fluorescent lamp 10. The lamp drive device 30 includes a power source, drive circuits and the like, and causes the flat fluorescent lamp 10 to illuminate in a manner of a surface light source. The flat fluorescent lamp 10 can be used in various fields in which surface light sources are utilized. For example, the flat fluorescent lamp 10 is used as an ordinary type of illuminating device, as a back light for a liquid crystal display panel, and as an optical fixing device in a color thermal printer.

In the present embodiment, local highness in the electric field strength occurs at each of the projections 25 in a great number on the surface of the transparent dielectric layer 19. Thus, emission of electron occurs more easily than a conventional flat type of the transparent dielectric layer 19. Discharge can be started even at a lower voltage of starting discharge. Also, operation of discharge can be maintained even at a small voltage of maintaining discharge. It is concluded that voltage applied to the flat fluorescent lamp 10 can be low. Pressure of gas enclosed in the flat fluorescent lamp 10 can be high, so luminous efficiency in light emission can be high.

If a conventionally shaped flat dielectric layer is used instead of the present invention, an accidental breakage is likely to occur. This is because an error may be occur with respect to the interval between the glass plates, and because natural discharge may occur locally at a portion with the smallest interval. However, the projections 25 are disposed in the entirety of the surface of the transparent dielectric layer 19, to cause discharge at numerous points without local local highness in the electric field strength. No damage due to the local highness in the electric field strength occurs.

In the above embodiment, the projections 25 are hemispherical. However, the projections 25 may be formed in a different shape. For example, the projections 25 may have a shape of a cylinder, cone, triangular prism, triangular pyramid, polygonal prism, polygonal pyramid, parabolic surface, or the like. In the above embodiment, all the projections 25 are arranged regularly. However, it is possible to change density of arranging the projections 25 locally between portions in the transparent dielectric layer 19. As shortage in the amount light is likely to occur in a peripheral portion and corner portions of the transparent dielectric layer 19, the projections 25 may be arranged in a peripheral portion and corner portions of the transparent dielectric layer 19 at a higher density than arrangement of the projections 25 in a central portion of the transparent dielectric layer 19.

The size of the projections 25 and their density of arrangement are determined suitably according to an amount of light emitted by the flat fluorescent lamp 10, its size and the like. It is preferable that the projections 25 have a height H of 1–4 mm, have the periphery of which a diameter D of 0.5–2.0 mm, and are arranged at a pitch P of 2–8 mm.

In the above embodiment, the transparent planar electrode layer 15 is formed to lie on all the surface of the glass substrate 11. Furthermore, material for the transparent planar electrode layer 15 may be disposed in a comb shape or net shape to constitute a planar transparent electrode.

Also, a pattern of plural ridges may be formed in the transparent dielectric layer 19 for the purpose of increasing luminous efficiency in emission of light by local highness in the electric field strength.

Also, the projections 26 may be formed instead of forming the projections 25. Only the projections 26 may be formed with the transparent dielectric layer 16 overlaid on the transparent planar electrode layer 15 without forming the projections 25 with the transparent dielectric layer 19 overlaid on the opaque planar electrode layer 18.

Furthermore, a corrugation pattern may be formed instead of the protruding pattern constituted by the projections 25, and may be corrugated in a saw-tooth shape as viewed in section.

Figure 3:
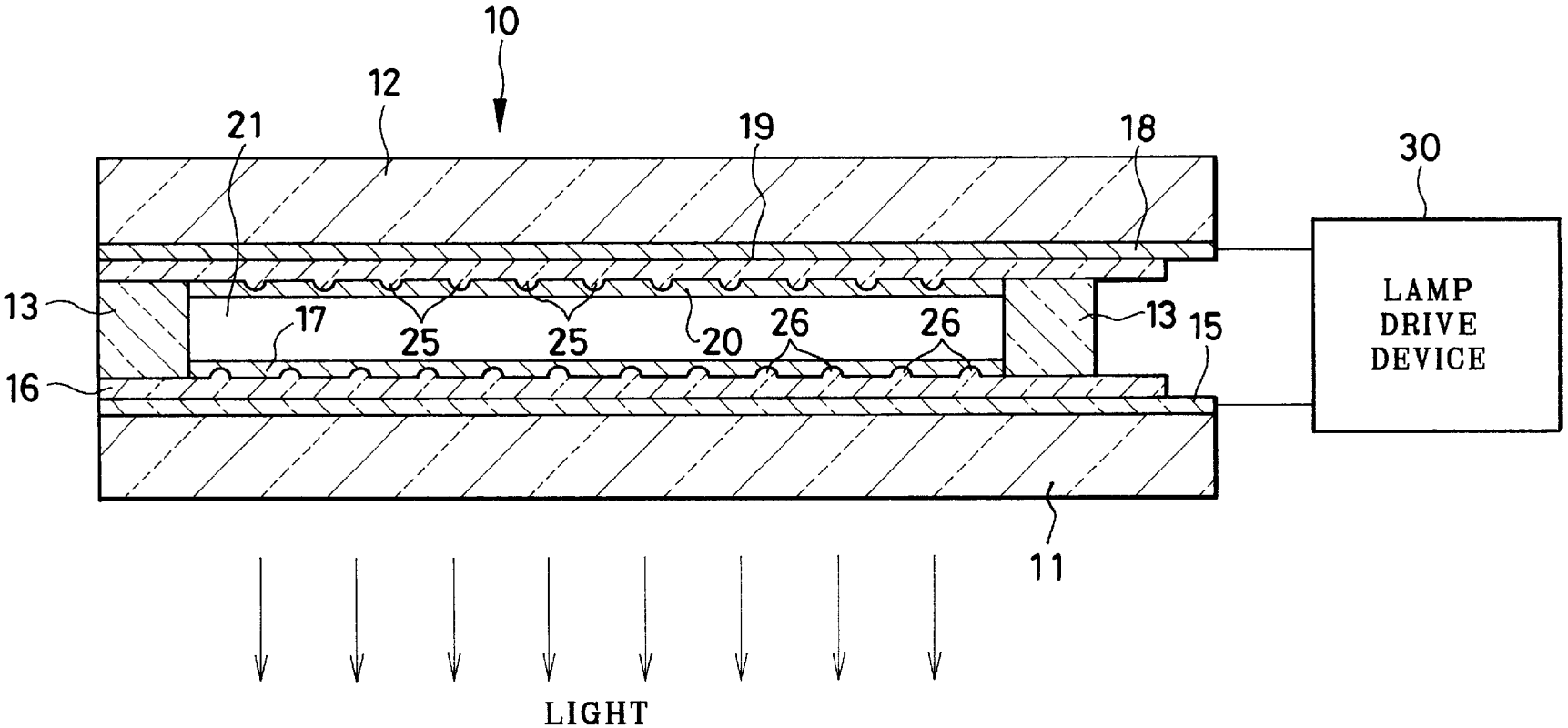
FIG. 3 is a section illustrating another preferred flat fluorescent lamp in which two dielectric layers have projections.

In FIG. 3, another preferred embodiment is depicted. Plural projections 26 in a protruding pattern are additionally formed to project from the transparent dielectric layer 16 of the glass substrate 11. Each of the projections 26 are the same as one of the projections 25. Also, the projections 26 are offset from any of the projections 25 on the transparent dielectric layer 19 as viewed in a direction of emission of light. Thus, the structure with the projections 25 and 26 on the transparent dielectric layers 16 and 19 facilitates emission of electron and raises luminous efficiency in light emission. The offset arrangement of the projections 25 and 26 is effective in uniform emission of light because of reduction of irregularity in light. Note that elements similar to those of FIG. 1 are designated with identical reference numerals.

Figure 4:
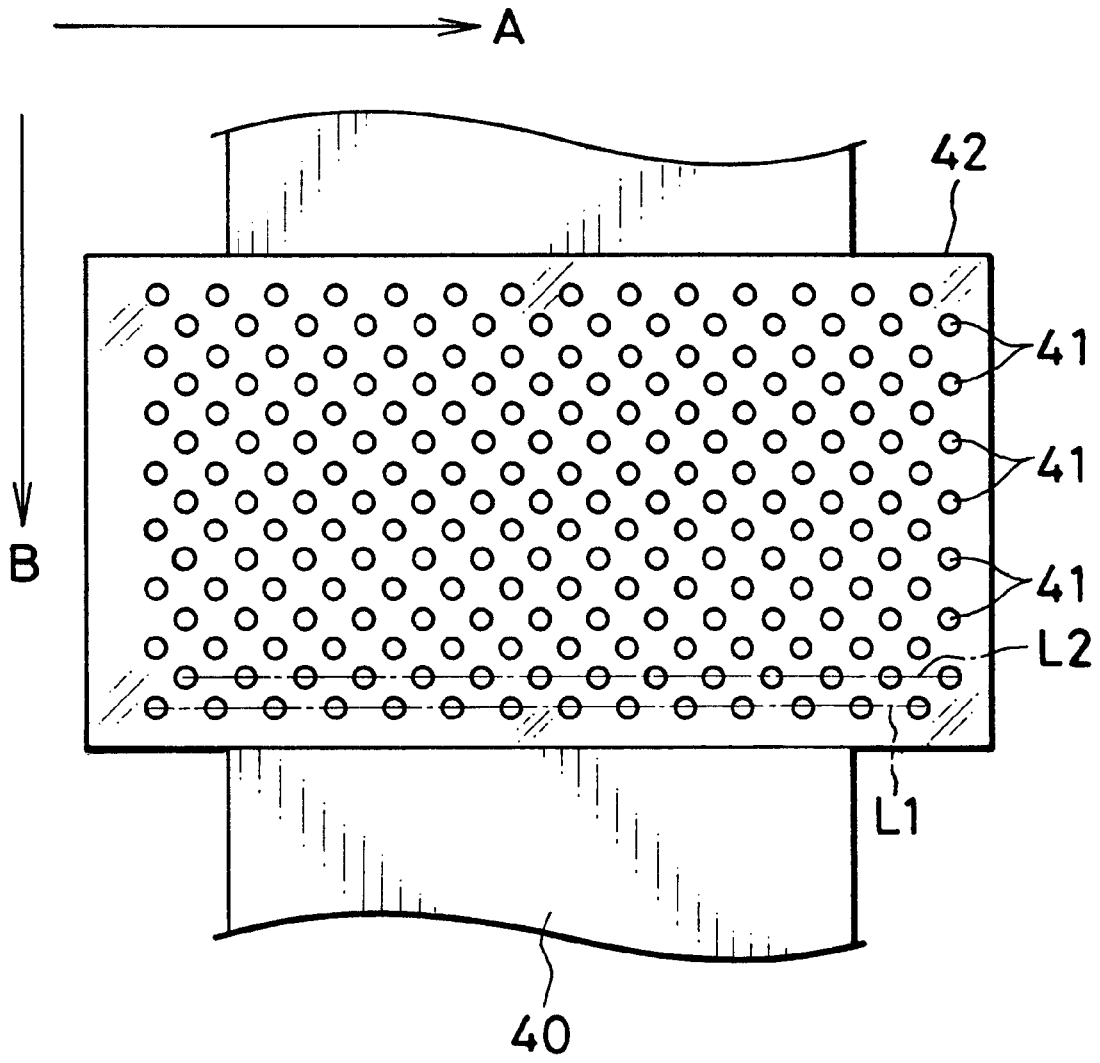
FIG. 4 is an explanatory view in plan illustrating a preferred transparent dielectric layer with projections positioned with reference to thermosensitive recording material.
Figure 5:
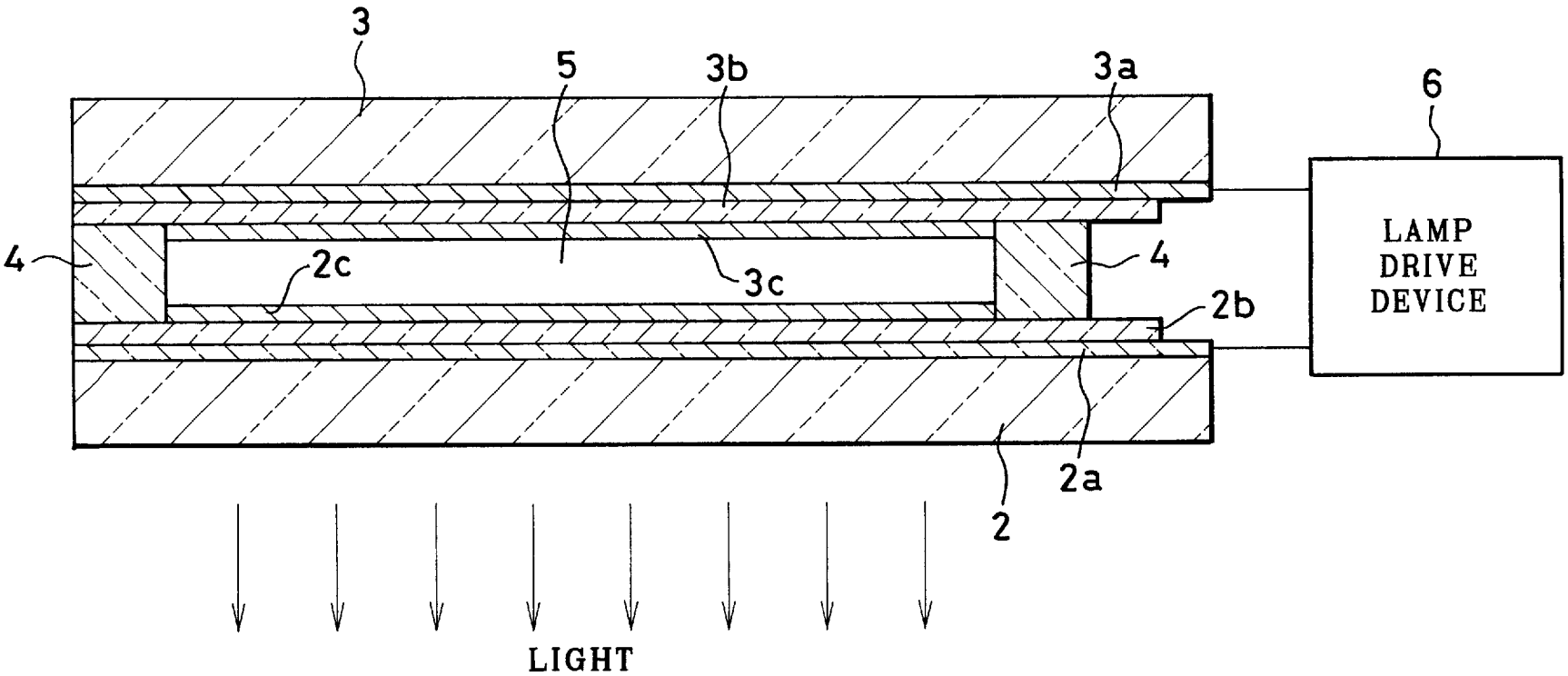
FIG. 5 (PRIOR ART)
FIG. 5 is a section illustrating a flat fluorescent lamp of the prior art.

In FIG. 4, an example of the flat fluorescent lamp 10 for use in a color thermal printer is depicted. The flat fluorescent lamp 10 includes a transparent dielectric layer 42. Plural projections 41 in a protruding pattern are arranged in an alternate manner between adjacent trains, so as to prevent occurrence of unevenness in fixing light in a feeding direction of color thermosensitive recording material 40. Projections included in each of the projection trains L1 and L2 are arranged at a regular pitch in a main scan direction A. The projection trains L1, L2 and so on are arranged at a regular pitch in a sub scan direction B. The projections included in the projection train L2 adjacent to the projection train L1 are arranged alternately with the projections included in the projection train L1.

Note that the recording sheet 40 includes a support and cyan, magenta and yellow thermosensitive coloring layers overlaid on one another in sequence. A protective layer is overlaid on the yellow coloring layer. A direction of thermal recording to the three coloring layers is toward the recording sheet 40. The yellow coloring layer has such a characteristic that its coloring ability is destroyed upon application of visible violet rays of a wavelength of approximately 420 nm. The magenta coloring layer has such a characteristic that its coloring ability is destroyed upon application of near ultraviolet rays of a wavelength of approximately 365 nm. The yellow and magenta fixing flat fluorescent lamps 10 are disposed in a feeding path for the recording sheet 40. The yellow and magenta fixing flat fluorescent lamps 10 emit ultraviolet rays of which peaks of wavelengths are respectively 420 and 365 nm.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A flat fluorescent lamp comprising:

a housing, including first and second substrates opposed to each other, and having discharge gas enclosed therein;

a first planar electrode being transparent, disposed on an inner surface of said first substrate;

a second planar electrode, disposed on an inner surface of said second substrate, for electrical discharge in cooperation with said first planar electrode;

first and second dielectric layers disposed on respectively said inner surfaces of said first and second substrates to lie on said first and second planar electrodes;

first and second fluorescent layers overlaid on respectively surfaces of said first and second dielectric layers, for emitting electromagnetic rays upon said electrical discharge; and a protruding pattern formed with said surface of said second dielectric layer.

2. A flat fluorescent lamp as defined in claim 1, wherein said protruding pattern includes plural projections.

3. A flat fluorescent lamp as defined in claim 2, wherein said electromagnetic rays are ultraviolet rays or near ultraviolet rays adapted for fixing thermosensitive recording material.

4. A flat fluorescent lamp as defined in claim 2, wherein said plural projections are arranged in a matrix manner.

5. A flat fluorescent lamp as defined in claim 1, further comprising a second protruding pattern formed with said surface of said first dielectric layer.

6. A flat fluorescent lamp as defined in claim 5, wherein said first protruding pattern includes a first group of plural projections, said second protruding pattern includes a second group of plural projections, and said plural projections in said second group are offset from said plural projections in said first group.

7. A flat fluorescent lamp as defined in claim 1, wherein said protruding pattern includes plural projection trains, each of said projection trains includes plural projections arranged at a pitch, and projections included in one first train of said projection trains are alternate with projections in one second train of said projection trains adjacent to said first train.

8. A flat fluorescent lamp as defined in claim 7, wherein said plural projections have a substantially hemispherical shape.

9. A flat fluorescent lamp as defined in claim 8, wherein said plural projections have a height of 1–4 mm and a diameter of 0.5–2.0 mm, and are arranged at a pitch of 2–8 mm.

10. A flat fluorescent lamp as defined in claim 1, wherein said first planar electrode is formed from indium tin oxide, said second planar electrode is formed from aluminum, and said first and second dielectric layers are formed from silicon dioxide.

11. A flat fluorescent lamp as defined in claim 1, wherein said protruding pattern is formed by photolithography and etching.

12. An optical fixing device for applying electromagnetic rays to thermosensitive recording material for fixation, comprising:

a housing, including first and second substrates opposed to each other, and having discharge gas enclosed therein;

a first planar electrode being transparent, disposed on an inner surface of said first substrate;

a second planar electrode, disposed on an inner surface of said second substrate, for electrical discharge in cooperation with said first planar electrode;

first and second dielectric layers disposed on respectively said inner surfaces of said first and second substrates to lie on said first and second planar electrodes;

first and second fluorescent layers overlaid on respectively surfaces of said first and second dielectric layers, for emitting said electromagnetic rays upon said electrical discharge; and a protruding pattern formed with said surface of said second dielectric layer.

13. A flat fluorescent lamp as defined in claim 12, wherein said protruding pattern includes plural projections.

14. A flat fluorescent lamp as defined in claim 13, wherein said electromagnetic rays are ultraviolet rays or near ultraviolet rays.

15. A flat fluorescent lamp as defined in claim 13, wherein said plural projections are arranged in a matrix manner.

16. A flat fluorescent lamp as defined in claim 13, further comprising a second protruding pattern formed with said surface of said first dielectric layer.

* * * * *